United States Patent [19]

Ernst et al.

[11] 4,258,491

[45] Mar. 31, 1981

[54] LOCATION INDICATING DEVICE

[76] Inventors: Frank J. Ernst, 405 E. 56th St., New York, N.Y. 10022; Milton P. Chernack, 399 June Pl., West Hempstead, N.Y. 11552; Gordon R. Perry, 1809 Albemarle Rd., Brooklyn, N.Y. 11226

[21] Appl. No.: 25,715

[22] Filed: Mar. 30, 1979

[51] Int. Cl.[3] ..... G09F 11/26

[52] U.S. Cl. ..... 40/525; 40/118

[58] Field of Search ..... 40/525, 524, 518, 118, 40/2 A, 330

[56] References Cited

U.S. PATENT DOCUMENTS

| | | | |
|---|---|---|---|
| 968,363 | 8/1910 | Kendig | 40/118 |
| 1,246,860 | 11/1917 | Brachtl et al. | 40/518 |
| 1,553,375 | 9/1925 | Gashyesva | 40/118 |
| 1,704,534 | 3/1929 | Depler | 40/525 X |
| 2,511,612 | 6/1950 | Wilson | 40/525 |
| 2,842,877 | 7/1958 | Stevens | 40/495 X |
| 3,310,896 | 3/1967 | Ruffner | 40/525 |
| 3,747,246 | 7/1973 | Sarier | 40/518 |
| 3,991,498 | 11/1976 | Beach | 40/518 |

*Primary Examiner*—John F. Pitrelli

*Attorney, Agent, or Firm*—Robert H. Epstein

[57] ABSTRACT

A location indicating device has a size and shape to be carried on a key ring or chain and is adjustable to display various indicia corresponding to a location, such as that of a parked vehicle. The location indicating device is formed of a flat housing having opposite display and operating ends and an adjustable indicator assembly disposed in the housing including indicating strips carrying indicia for positioning at the display end, the indicating strips being movable via rotatable thumb wheels extending externally of the housing at the operating end to permit selective rotation thereof for positioning selected indicia at the display end of the housing.

8 Claims, 5 Drawing Figures

LOCATION INDICATING DEVICE

BACKGROUND OF THE INVENTION

1. Field of the Invention

The present invention pertains to an indicating device and, more particularly, to a device for indicating the location of an object, such as a parked vehicle.

2. Discussion of the Prior Art

With the advent of large shopping malls, the increase in air traffic and the large attendances at sporting and entertainment events, many large complexes have been built having surrounding parking areas of similar appearance in order to accommodate the large numbers of people driving vehicles to such areas. Quite frequently, drivers, upon leaving such areas, cannot find their vehicle due to the many parking areas and the similarity thereof thus causing a great loss of time and, in many cases, great anxiety. In an attempt to solve this problem, it has become the practice to denote general parking areas and lanes with indicia, such as letters, numbers, symbols or the like, to permit a driver to find his vehicle by merely remembering the general area and lane indicia representative of where he parked. Unfortunately, this requires the awkward procedure of either relying on one's memory or using a pencil and paper to note the location of the vehicle, both of these methods being disadvantageous due to the human failure of memory and the fact that, in many cases, pencil and paper are not available to note the location while, in other cases, the driver does not take the time to note the location.

SUMMARY OF THE INVENTION

Accordingly, it is an object of the present invention to overcome the above-mentioned disadvantages of the prior art by providing a location indicating device which is small in size and conveniently shaped to permit it to be attached to a key ring or key chain, the location indicating device thus being always available for setting of indicia therein relative to the location of a parked vehicle and for easy and convenient reference when it is desired to find the vehicle.

Another object of the present invention is to construct a location indicating device with a generally flat, rectangular configuration having opposite display and operating ends with indicating strips disposed within the housing and movable by thumb wheels at the operating end to position desired indicia corresponding to a location, such as that of a parked vehicle, at the display end of the housing.

The present invention has a further object in that an adjustable indicator assembly can be simply placed in and removed from a housing of a location indicating device as a unit.

Some of the advantages of the present invention over the prior art are that the location indicating device can be conveniently carried on a key ring or chain so as to be readily available for storing indicia representative of the location of a parked vehicle, the location indicating device can be inexpensive, produced of plastic components and can be simply assembled and the lid provides an attractive and easily viewable display.

The present invention is generally characterized in a location indicating device including a flat housing having a display end and an operating end, an adjustable indicator assembly disposed in the housing including a plurality of indicating strips movable within the housing and carrying indicia for positioning at the display end of the housing, and a plurality of thumb wheels positioned at the operating end of the housing to engage and move the indicating strips, the thumb wheels extending externally of the housing for selective rotation by a user to position selected indicia at the display end of the housing.

Other objects and advantages of the present invention will become apparent from the following description of the preferred embodiment taken in conjunction with the accompanying drawings.

DESCRIPTION OF THE PREFERRED EMBODIMENT

Figure 1:
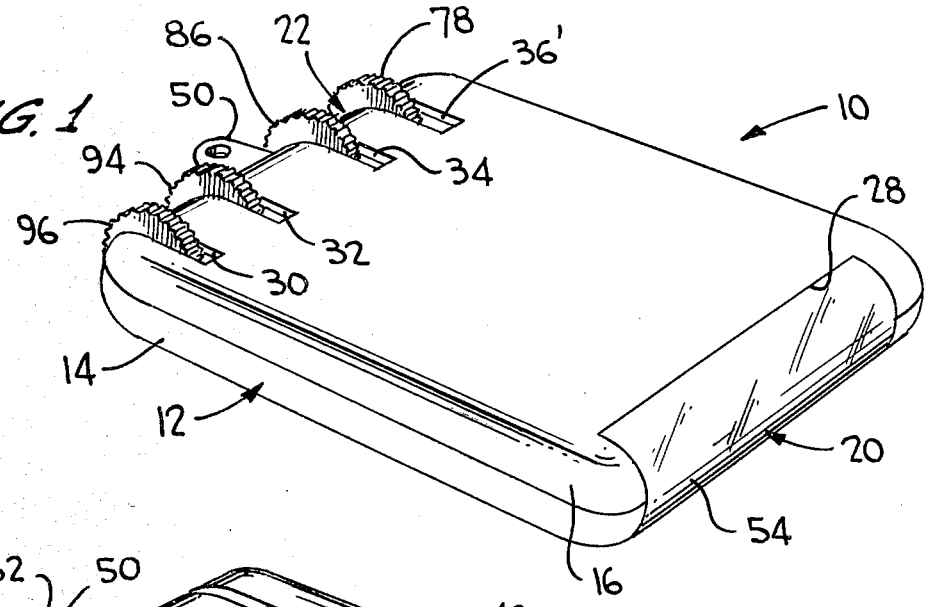
FIG. 1 is a perspective view of a location indicating device according to the present invention.

A location indicating device 10 according to the present invention is illustrated in FIG. 1 and is formed of a housing 12 constructed of similar members 14 and 17, preferably made of plastic. The housing 12 is of relatively small size and has a generally flat, rectangular configuration to permit it to be attached to a key chain or key ring and easily carried in a pocket or purse. The members 14 and 16 of the housing are of identical shape and structure; and, thus, only the bottom member 14 will be described in detail with identical structure of the cover member 16 given identical reference numbers.

Figure 2:
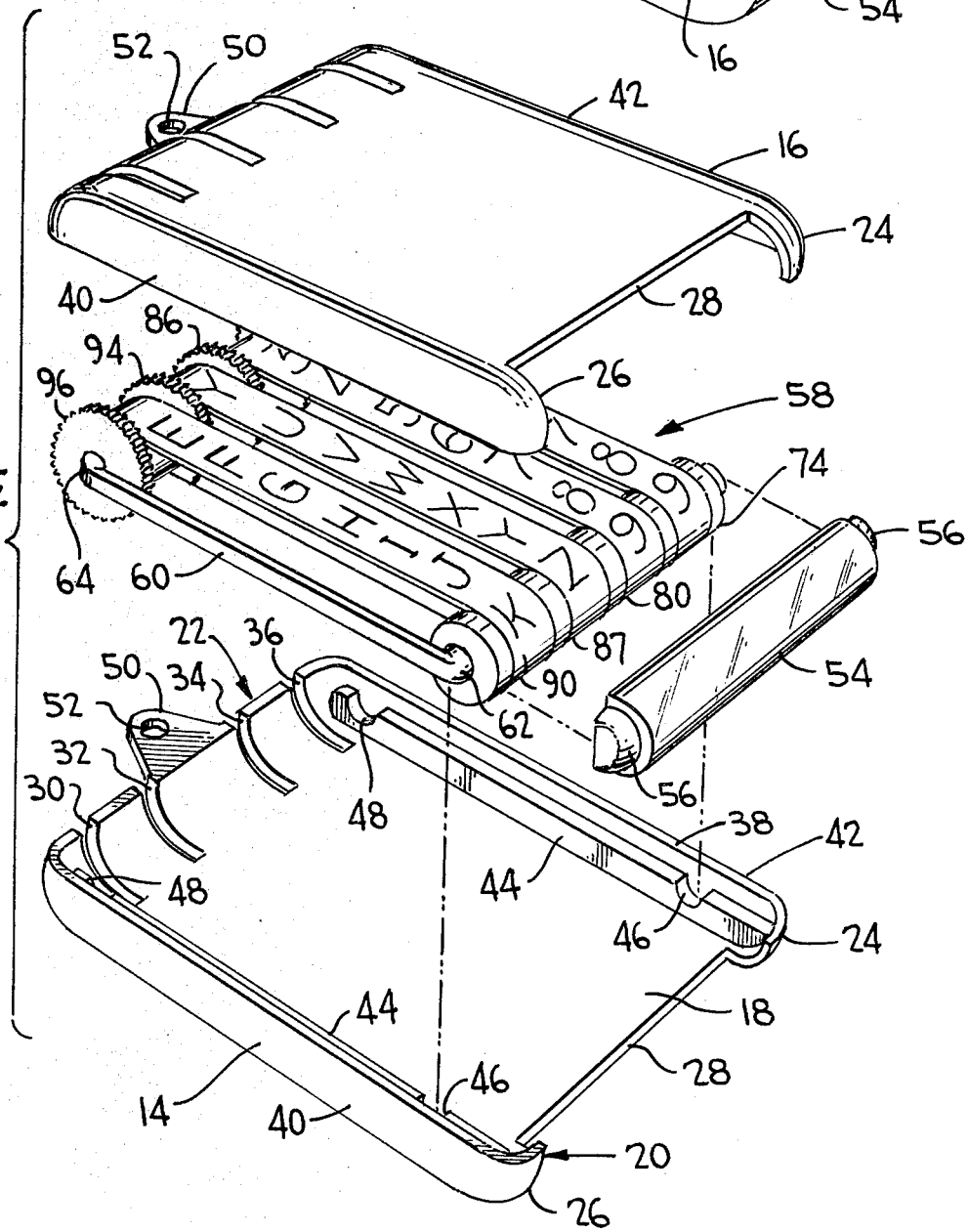
FIG. 2 is an exploded view of the location indicating device of the present invention.

As best illustrated in FIG. 2, the member 14 has a flat planar surface 18 extending between a display end 20 and an operating end 22 of the housing. At the display end 20, the member 14 has spherically curved edges 24 and 26 extending laterally and upwardly of a straight edge 28 of an opening formed in the display end 20 of the housing. At the operating end, the flat surface 18 curves upwardly and has slots 30, 32, 34 and 36 therein extending from a peripheral lip 38 of the member 14 to a position along the flat planar surface 18, the peripheral lip 38 extending along side walls 40 and 42 as well as along the operating end 22. Along each side wall 40 and 42 is a rail 44 having arcuate recesses 46 adjacent the display end 20 and arcuate recesses 48 adjacent the operating end 22. An ear 50 extends laterally from the operating end of the housing and has a hole 52 therein to receive a key chain or key ring or the like.

Figure 4:
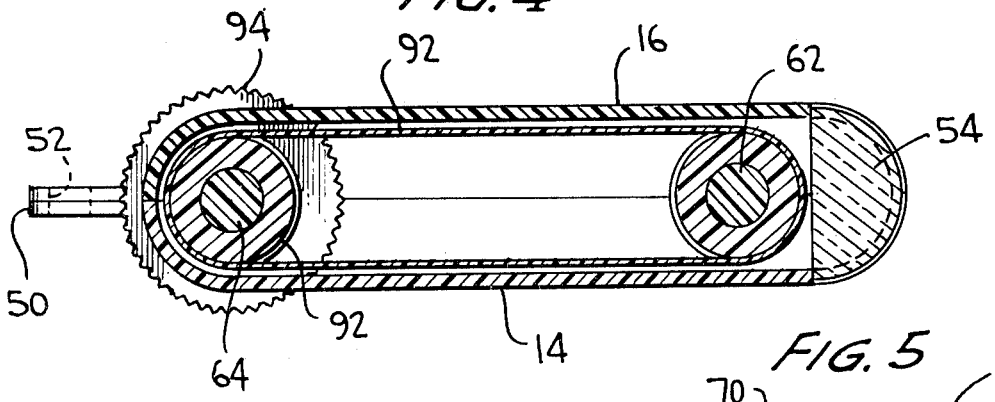
FIG. 4 is a section taken along line 4—4 of FIG. 3.
Figure 5:
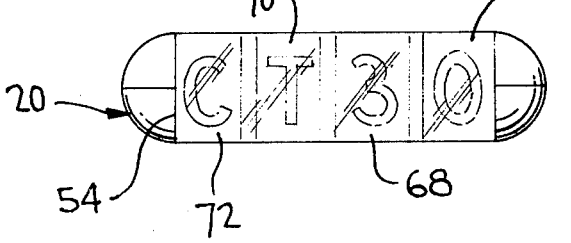
FIG. 5 is an end view of the display end of the location indicating device of the present invention.

A plastic window 54 has rounded lugs 56 extending from either end and is shaped to cover the opening defined by edges 28 in the display end 20 of the housing, the lugs 56 being received in the spherical curved ends 24 and 26 of the members 14 and 16. As best illustrated in FIG. 4, the window 54 has a semi-cylindrical solid configuration and is desirably formed of plastic, preferably defining a magnifying lens.

Figure 3:
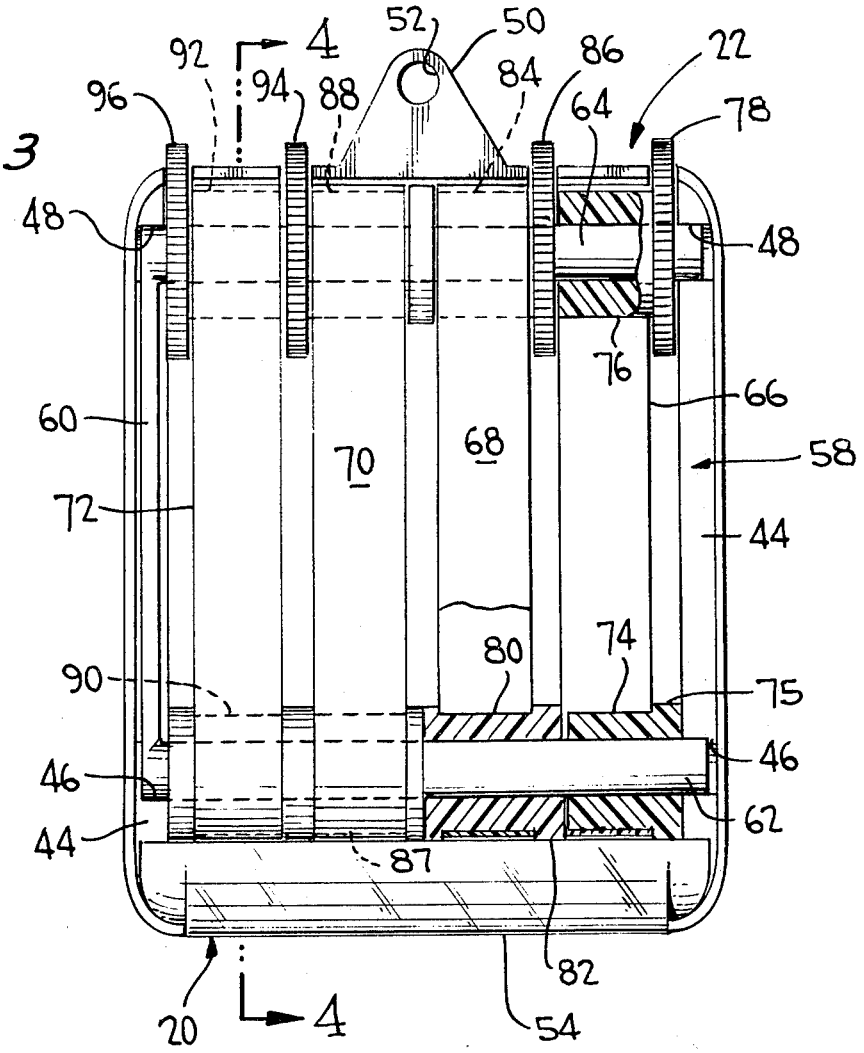
FIG. 3 is a broken top plan view of the location indicating device of the present invention with a housing member removed.

An adjustable indicator assembly 58 is disposed in the housing 12 and includes a U-shaped frame having a cross bar 60 extending transversely between parallel, spaced shafts 62 and 64, ends of the shafts 62 and 64 being supported in the recesses 46 and 48, respectively, in the side walls of the members 12 and 14. As best shown in FIG. 3, the indicator assembly 58 includes indicating strips 66, 68, 70 and 72, each in the form of an endless belt extending around pulleys rotatably mounted on shafts 62 and 64. Indicating strip 66 extends around a pulley 74 rotatably mounted on shaft 62 and having a flange 75 at the outer end thereof to position the indicating strip at the display end 20 of the housing; and, at the operating end 22 of the housing, indicating strip 66 extends around a pulley 76 rotatably mounted on shaft 64 and carrying a knurled flange forming a thumb wheel 78 extending externally of the housing through a slot 36. In similar fashion, indicating strip 68 extends around a pulley 80 rotatably mounted on shaft 62 and having a positioning flange 82 extending therefrom and, at the operating end, around a pulley 84 from which extends a knurled thumb wheel 86 extending externally of the housing through slot 34. Indicating strips 70 and 72 are similarly mounted on pulleys 87, 88, 90, 92, respectively, pulleys 88 and 92 carrying thumb wheels 94 and 96, respectively, and extending externally of the housing via slots 32 and 30.

The indicating strips 66, 68, 70 and 72 carry suitable indicia to provide an indication of the location of an object, such as a parked vehicle. For example, indicating strips 70 and 72 could carry the letters of the alphabet while strips 66 and 68 carry numbers. The indicating strips can be made of any suitable thin flexible material, such as paper or plastic, and tautly extend around the pulleys such that when the thumb wheels are turned, the pulleys at the operating end 22 of the housing 12 rotate on shaft 64 to move the indicating strips and rotate the pulley on shaft 62 at the display end 20 of the housing.

The adjustable indicator assembly 58 is assembled prior to mounting in the housing; and, accordingly, indicator assemblies having various indicia, such as symbols and/or illustrations as well as numbers and letters, can be simply mounted in a housing by merely separating the housing members 14 and 16 and dropping an indicator assembly having desired indicia in place in the housing with the ends of shafts 62 and 64 received in recesses 46 and 48. In this manner, the location indicating device 10 can be simply modified for use in many different areas using all means of indicating vehicle parking areas.

In use, the location indicating device 10 can be unobtrusively carried by an individual due to its small size and flat configuration, the location indicating device being advantageously connected with a key ring or chain via hole 52 in ear 50. Once an individual has parked his vehicle, indicia corresponding to the location of the parked vehicle, such as general area, geographical direction, row and/or space, is set in the location indicating device 10 by turning the appropriate thumb wheels to position the desired indicia at the display end of the housing. The window 54 permits viewing of the indicia; and, while the indicia carried by the indicating strips is necessarily small to permit the location indicating device 10 to be as small as possible, the window 54 acts as a magnifying lens to increase the size of the displayed indicia image. Once the proper indicia are positioned at the display end of the housing, the location indicating device 10 is placed in a pocket, purse or other place along with the keys for reference when it is time to find the parked vehicle. The pulleys around which the endless belt indicia strips extend engage shafts 62 and 64 with a slight friction fit such that the pulleys resist turning and thereby resist accidental movement during normal storage of the location indicating device with the keys.

The housing members 14 and 16, the U-shaped frame of the indicator assembly 58 and the pulleys are preferably constructed of plastic, and the pulleys and indicia strips are slid onto the shafts 62 and 64 in any order desired to facilitate assembly and change of indicia. The pulleys do not have to be held in place on the shafts other than by friction because, when the indicator assembly is mounted in the housing, the outer pulleys 74, 76, 90 and 92 abut the side walls 40 and 42 of the housing members 14 and 16. Of course, suitable structure will be provided to permit the housing members to be held together, such as mating dimples and recesses, as is conventional.

Inasmuch as the present invention is subject to many variations, modifications and changes in detail, it is intended that all subject matter discussed above or shown in the accompanying drawings be interpreted as illustrative and not in a limiting sense.

What is claimed is:

1. A location indicating device comprising a housing having a generally flat configuration with a display end along an edge thereof and an opposite operating end having slots therein, the housing being of a relatively small size to be carried on a person;

an adjustable indicator assembly disposed in said housing including a plurality of endless belt indicating strips movable within said housing and carrying indicia for positioning at said display end of said housing for edgewise viewing, a plurality of pulleys rotatably mounted at said operating end of said housing, each of said endless belt indicating strips extending around one of said pulleys, and a plurality of thumb wheels positioned at said operating end of said housing each integrally formed with one of said pulleys to engage and move said endless belt indicating strips, said thumb wheels extending externally of said housing through said slots in said operating end for selective rotation by a user to position selected indicia at said display end of said housing; and a transparent window disposed at said display end of said housing forming a lens for magnifying images of said indicia carried on said endless belt indicating strips.

2. A location indicating device as recited in claim 1 wherein said indicator assembly includes a first shaft mounted at said operating end of said housing, said first mentioned plurality of pulleys being rotatable on said first shaft, and a second plurality of pulleys rotatable on said second shaft, said endless belt indicating strips extending around said first and second pulleys.

3. A location indicating device as recited in claim 2 wherein said indicator assembly includes a frame formed of said first and second shafts and a cross bar extending transversely therebetween whereby said indicator assembly can be disposed and removed from said housing as a unit.

4. A location indicating device as recited in claim 3 wherein said frame of said indicator assembly has a U-configuration.

5. A location indicating device as recited in claim 4 wherein said housing has a rectangular configuration and is constructed of a pair of plastic members.

6. A location indicating device as recited in claim 5 wherein said housing members each have side walls with recesses therein adjacent said operating end to support said first shaft and recesses therein adjacent said display end to support said second shaft.

7. A location indicating device as recited in claim 6 wherein said housing members have edges defining an opening in said display end of said housing and said transparent window has a convex outer surface mounted in said opening.

8. A location indicating device as recited in claim 7 wherein said window has a semi-cylindrical configuration.

* * * * *